United States Patent [19]

Anderson

[11] 4,331,271

[45] May 25, 1982

[54] SLING FOR SHOULDER GUNS

[76] Inventor: Jeffery J. Anderson, P.O. Box 11, McCann Mill Rd., Pottersville, N.J. 07979

[21] Appl. No.: 236,222

[22] Filed: Feb. 19, 1981

[51] Int. Cl.[3] ..... A41F 15/00

[52] U.S. Cl. ..... 224/150; 224/252; 224/258; 224/269; 224/913; 42/85

[58] Field of Search ..... 224/149, 150, 203, 208, 224/252, 257, 258, 262–264, 269, 913; 2/94, 312; D22/13, 14; 42/85

[56] References Cited

U.S. PATENT DOCUMENTS

| | | | |
|---|---|---|---|
| 745,866 | 12/1903 | Laing | 224/203 |
| 811,437 | 1/1906 | Read | 224/913 |
| 919,301 | 4/1909 | Anderson | 224/913 |
| 2,543,703 | 2/1951 | Pelto | 224/149 |
| 2,564,564 | 8/1951 | Cookman | 224/208 |
| 3,098,591 | 7/1963 | Lerude | 224/913 |
| 3,664,558 | 5/1972 | Tolliver | 224/911 |
| 3,869,074 | 3/1975 | Roach | 224/913 |
| 3,998,367 | 12/1976 | Harding | 224/208 |

FOREIGN PATENT DOCUMENTS

| | | | |
|---|---|---|---|
| 208445 | 3/1909 | Fed. Rep. of Germany | 224/913 |
| 300356 | 9/1917 | Fed. Rep. of Germany | 224/913 |
| 487474 | 4/1918 | France | 224/203 |
| 327158 | 8/1970 | Switzerland | 224/913 |
| 7499 | of 1901 | United Kingdom | 224/913 |
| 13803 | of 1906 | United Kingdom | 224/257 |
| 129082 | 6/1918 | United Kingdom | 224/913 |

*Primary Examiner*—Stephen P. Garbe
*Assistant Examiner*—Gary E. Elkins
*Attorney, Agent, or Firm*—Fisher, Christen & Sabol

[57] ABSTRACT

A sling for carrying a shoulder operated gun, such as a rifle or shotgun, consists of a strap which may be attached to the rear swivel of a gun, then passed through the front swivel and over one shoulder, then diagonally downwardly across the chest to be attached to a belt at the other side of the body.

6 Claims, 5 Drawing Figures

SLING FOR SHOULDER GUNS

BACKGROUND OF THE INVENTION

This invention relates to a harness, or sling, which enables a person, such as a hunter, to carry a shoulder operated gun, such as a rifle or shotgun, in a position at the back of the body in a vertical position with the muzzle pointed upwardly so that the hands and arms are left completely free.

A harness for carrying a gun in such a position is disclosed in U.S. Pat. No. 3,098,591. However, the arrangement shown in said patent resembles, in effect, a "three-point hitch" and it is difficult to detach the gun from its carrying position when the gun is wanted for use.

Other types of gun-carrying devices are known but the gun is usually placed in front of the body in the position known in military drill as "port arms." However, even if the gun is placed in a holster from which it can be quickly removed and whereby the hands are arms are unencumbered, the position of the gun is awkward and, in the case of a hunter moving through underbrush or low tree limbs, it can obstruct movement. Slings, or holsters, of this latter type are shown in U.S. Pat. Nos. 3,869,074 and 3,664,558.

Slings, or hosters, in which a gun is loosely carried in a vertical position in front of the body are disclosed in U.S. Pat. Nos. 2,543,703 and 919,301. However, when running, it is essential for the user to keep one hand on the gun to hold it in place with the arrangements shown on these latter patents.

SUMMARY OF THE INVENTION

The applicant has solved these problems by attaching a long strap to a rifle, or shotgun, in such a way that the gun is suspended at the user's back, behind the shoulder which is used for firing the gun and in an upright position at a level at which it is possible for the gun barrel to be grasped by the hand which usually holds that part of the gun and swing the gun over the shoulder into immediate position for firing.

The strap attached to the gun preferably extends from a point adjacent the butt end and is also attached to the lower side of the gun at another point forwardly of the trigger quard and is of sufficient length to extend over one shoulder and diagonally downwardly over the chest to connect with a waist encircling belt on a location on the opposite side of the body. In this way the weight of the gun develops a lateral component of force which keeps the belt from slipping off the shoulder, even when the user is running.

The strap, furthermore, performs two other functions; (a) it serves to act as a cushion between the forwardly projecting trigger quard and the user's back when the gun is carried and (b) it serves as a stabilizing sling for the forward arm when the gun is aimed.

Finally, the strap can be detachably secured to the belt, or the belt may be provided with a quick-acting release so that if the gun becomes untangled in some object the user can easily free himself immediately.

Figure 1:
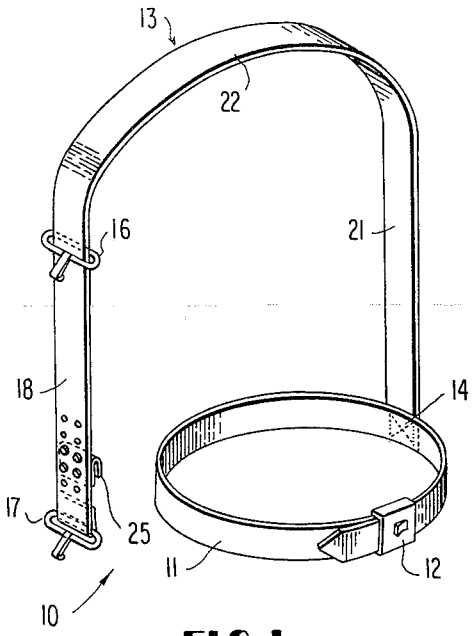
FIG. 1 is a perspective view of a preferred form of assembled sling according to the invention.

In the drawing the preferred form of sling is indicated generally by numeral 10. It comprises a belt 11, of canvas, leather, or other suitable material to encircle the waist of the user the ends of the belt being connected together at the front of the body by means of a buckle 12, which may be of the length-adjusting type and preferably includes a quick-release device to permit the belt to be removed quickly.

A strap, indicated generally by numeral 13, of leather, or similar material, has one end attached to the belt at a location 14 which will be disposed at one side or the other of the user's body when the belt is in place. In the case of a person who places the butt of a gun against the right shoulder when aiming it, the strap 13 will join the belt 11 at the left side of the body. Obviously, in the case of a left-handed person, the opposite side would be correct.

Figure 2:
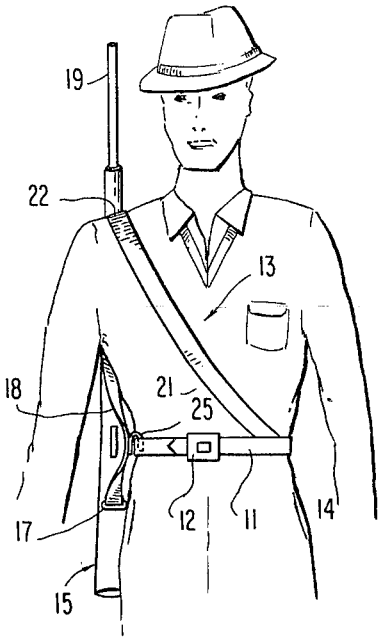
FIG. 2 is a front view of the sling when in use for carring a gun.

As can be seen in FIG. 2, the strap passes diagonally upwardly across the chest of the user and over the shoulder on the opposite side of the body from where the strap joins the belt and thence downwardly behind that shoulder.

Figure 3:
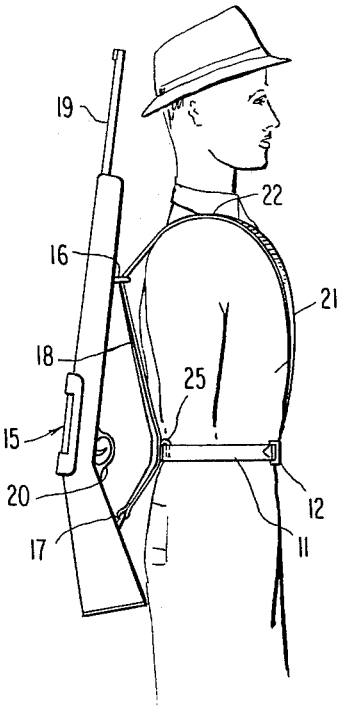
FIG. 3 is a side view of the sling.

In case the gun, indicated generally by numeral 15, is provided with front and rear sling swivels 16 and 17 the depending portion 18 of the strap is passed loosely through the front swivel 16 and has its free end attached to the rear swivel 17 so that because the swivel 16 is forward of the center of gravity, when the gun is carried it will be suspended upright, with the muzzle of barrel 19 pointing skyward and the trigger guard 20 facing forwardly, as seen in FIG. 3. The length of strap 13 should be such that when carried in the suspended position a portion of the barrel 19 projects above the level of the shoulder, for a reason to be explained.

It should be observed that when the gun is carried in the suspended position of FIGS. 1 and 2, the weight of the gun acting on the front diagonal portion 21 of the strap will create a laterally inward component of force on the shoulder engaging portion 22 of the strap which is effective, even when running, to prevent the strap from being displaced from the shoulder. In addition, that portion of the strap 18 between the swivels acts as a cushion between the forwardly projecting trigger quard 20 and the back of the user.

Figure 4:
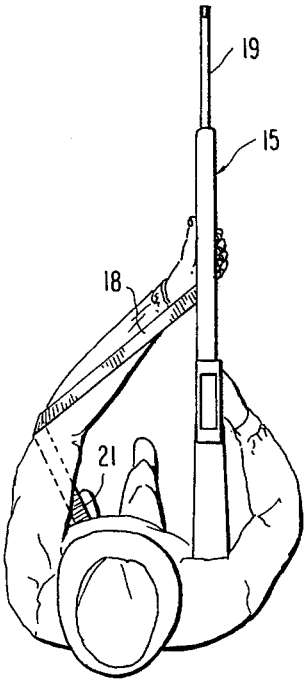
FIG. 4 is a view of the sling as used when the gun is being aimed and fired.

When the gun is to used, it is only necessary for the user to reach upwardly and grasp the projecting barrel 19 with the hand that normally grips the foward portion of the gun (the left hand, when the gun butt is placed against the right shoulder) and pull the gun forwardly with a swinging motion, using the shoulder as a fulcrum. At the same time the free hand (the right one in this case) is raised directly upwardly to grasp the gun at the usual location for aiming and pulling the trigger. During these motions, which are entirely natural and require little or no practice, the left arm can be inserted behind the strap 13, as shown in FIG. 4, whereby the strap now assists in stabilizing the gun while it is being aimed. When finished with the gun it can be returned to the carrying position by a simple movement of the left arm. There is no fumbling for a latch, or a holster pocket.

As stated above; if the belt bucket 12 includes a quick-release mechanism it is possible to immediately disengage one's self if the gun itself should accidentally become entangled with an obstruction. In that situation, it is only necessary to remove the belt by actuation of the quick-release mechanism located in a conveniently accessible position.

Figure 5:
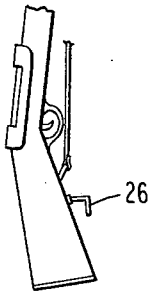
FIG. 5 is an elevational view of a modified form of the invention.

Up to this point no mention has been made of the fact that, while the arrangement just described is satisfactory, there is a tendency if the gun is carried for a long period of time for the front end of the strap 13 to exert an upward pull at point 14 wherein it is connected to the belt 11. This tendency can be overcome by the inclusion of a downwardly directed hook 25 which may be attached to the rear end of strap 13 in a position to be hooked on to the wearer's belt to support at least a portion of the weight of the gun at that point, so as to offset the upward pull at point 14 on belt 11. In the alternative, downwardly facing hook 26 may be secured to the under side of the butt of the gun, as shown in FIG. 5.

Other modifications and improvements will be apparent to those skilled in the art which would come within the scope of the annexed claims.

I claim:

1. In a sling for carrying a shoulder weapon having a barrel end and a butt end and an attaching element at each of said ends, said sling comprising:

two strap sections;

the first of said strap sections having two free ends and having a length sufficient to encircle the waist of a wearer when said free ends are coupled together;

the second of said strap sections having one end portion fixedly attached to said first strap section intermediate said two free ends;

the other end portion of said second strap section being adapted for cooperation with said butt end attaching element of a weapon to be carried;

said second strap section having a length such that when the sling is worn the said second strap section extends diagonally over the wearer's chest and downwardly over the wearer's back;

said second strap section including quick-release attaching means adjacent said other end portion for releasably securing said second strap section to said first strap section at a location remote from the location where said one end is fixedly attached to said first strap section;

said second strap section having a lengthwise sliding connection with said barrel end attaching element of a weapon to be carried;

whereby a shoulder weapon can be carried while disposed on a generally vertical plane with the barrel end pointing upwardly and said quick-releasable attaching means can be released and the weapon can be shifted simultaneously with one hand to a position for use with the butt end of the weapon against the wearer's shoulder and the arm of one hand cradled within a portion of said second strap section remote from the weapon.

2. A sling as defined in claim 1, wherein a weapon can be carried with the barrel disposed generally perpendicular to a horizontal plane.

3. A sling as defined in claim 2, wherein said quick-releasable attaching means comprises a hook-shaped element attached to said second strap section, the open end of said hook-shaped element facing downwardly for load-transferring engagement with the upper marginal portion of said first strap section when a weapon is being carried.

4. A sling as defined in claim 3 wherein the attaching element of at least one end of a weapon to be carried comprises a swivel.

5. A sling as defined in claim 4, wherein the attaching element at each of the ends of a weapon to be carried comprises a swivel.

6. A sling as defined in any one of claims 2, 3, 4 or 5, wherein additional quick-release attaching means is included in one of said strap sections to enable the wearer to separate himself from an entangled weapon.

* * * * *